US008951081B2

(12) United States Patent
Grandinetti et al.

(10) Patent No.: US 8,951,081 B2
(45) Date of Patent: Feb. 10, 2015

(54) LIFE RING BUOY AND FLOTATION CUSHION

(76) Inventors: Thomas Paul Grandinetti, Fort Lauderdale, FL (US); Karl Baron Rohl, Babylon, NY (US)

( * ) Notice: Subject to any disclaimer, the term of this patent is extended or adjusted under 35 U.S.C. 154(b) by 139 days.

(21) Appl. No.: 13/463,553

(22) Filed: May 3, 2012

(65) Prior Publication Data

US 2012/0282831 A1 Nov. 8, 2012

Related U.S. Application Data

(60) Provisional application No. 61/481,870, filed on May 3, 2011.

(51) Int. Cl.
*B63C 9/08* (2006.01)

(52) U.S. Cl.
USPC ..... 441/81

(58) Field of Classification Search
CPC ..... B63C 9/08; B63C 9/082; B63C 9/26
USPC ..... 441/80, 81, 84
See application file for complete search history.

(56) References Cited

U.S. PATENT DOCUMENTS

| | | | | |
|---|---|---|---|---|
| 1,728,106 | A | 9/1929 | Collins et al. | |
| 1,773,462 | A | 8/1930 | Lambdin et al. | |
| 2,260,109 | A | 10/1941 | Amdal et al. | |
| 2,342,868 | A | 2/1944 | King et al. | |
| 3,099,845 | A | 8/1963 | Chamberlain et al. | |
| 3,378,865 | A | 4/1968 | Pigg et al. | |
| 4,033,276 | A | 7/1977 | Barr | |
| 4,416,640 | A | 11/1983 | Eickenhorst | |
| 4,836,815 | A * | 6/1989 | Spurgeon | 441/84 |
| 6,568,976 | B2 | 5/2003 | Anderson et al. | |
| 7,285,032 | B2 * | 10/2007 | Cha | 441/81 |
| 8,216,014 | B2 * | 7/2012 | Samelian | 441/81 |

* cited by examiner

*Primary Examiner* — S. Joseph Morano
*Assistant Examiner* — Andrew Polay

(57) ABSTRACT

The present invention is an improved life ring buoy and flotation cushion that has the ability to be deployed and retrieved to aide a distressed person from drowning. The present invention has the ability to emit light upon being deployed. The present invention combines a flotation device, a retrieval line and a plurality of illuminating sources. The retrieval line is stowed within a recessed cavity in the flotation device. The illuminating sources are switched on prior to deploying the flotation device. The retrieval line is protected from detrimental ultraviolent light because it is stowed within the flotation device. A temporary seal prevents the retrieval line from prematurely exiting the recessed cavity. The improved retrieval line has an eye spliced in the exposed end and wrapped in brightly colored protective tubing, eliminating direct exposure to sunlight. The exposed retrieval line eye is tethered to the mechanical switch for the integral lights.

3 Claims, 10 Drawing Sheets

LIFE RING BUOY AND FLOTATION CUSHION

The current application claims a priority to the U.S. Provisional Patent application Ser. No. 61/481,870 filed on May 3, 2011.

FIELD OF THE INVENTION

The present invention relates generally to life ring buoys and flotation cushions. More particularly, it is an improved life ring buoy and flotation cushion with multiple integral lights; that can facilitate consistent deployment without snarls, kinks or snags in its retrieval line.

BACKGROUND OF THE INVENTION

In 2004, the World Health Organization reported and estimated 388,000 deaths from drowning worldwide, which is the 3$^{rd}$ leading cause of unintentional injury and deaths. In the United States, there is an average of nine drowning related deaths per day. With each drowning death, it is estimated that about one to four nonfatal submersions, serious enough to result in hospitalization, occur. The international life saving federation (ILS) indicates that most of these drowning related deaths occurred within 60 seconds of the individual becoming submerged.

The ability to quickly deliver a flotation device to a person in danger of drowning is imperative in any rescue attempt. It is also critical for untrained persons to have the ability to deliver these flotation devices and be able to retrieve them without fouling. This is necessary to render proper, effective and immediate assistance. Typically, a life ring buoy or a flotation cushion is deployed to the person in distress to aid this person in staying above water; a retrieval line is used to pull the flotation device with the person in distress to safety, which is often to a boat, a shoreline, a dock, a poolside, a float or a bridge.

Life ring buoys and flotation cushions have been a valuable life saving asset for many years in emergency rescues of persons in distress and in need of assistance from drowning. There are two widely accepted and approved types of life ring buoys in use, the United States Coast Guard (USCG) approved Type IV and the Safety Of Life At Sea (SOLAS). Typically, both types are commercially available with a multifilament grab line secured in four places around the perimeter. The length of the retrieval line is dependent on the application and location. For example, passenger and cargo ships are required to have a retrieval line and a type IV life ring, twice the vertical height at which the retrieval line is stowed above the water line in the lightest seagoing condition. A buoyant lifeline is specified by SOLAS code for this application.

The procedure of deploying a flotation cushion or life ring buoy to a person in distress and retrieving the person with the line becomes hampered when the floatation aid fails to reach the person, due to fouling of the retrieval line. Commercially available standard U.S.C.G. approved type IV life rings use strobe lights with the retrieval line in which the retrieval line is stowed on racks, coiled up on a drum, coiled up in a bag, coiled up on the life ring rack and even tied up with a light weight, easily brake away string for the retrieval line to be released. All of which are unorganized and require preparation prior to deployment.

In use today, at very best, are life rings, retrievable lines and very big and bulky strobe lights. The three components are linked together in many different methods. Deploying three objects with just one person is awkward, with the distance and accuracy severely compromised. Resulting in precious time being lost when seconds could make the difference between a successful rescue and a failed rescue attempt.

The object of the present invention is to improve the response time and delivery accuracy of the flotation aid to the person requiring assistance. It is also the object of the present invention to protect the retrieval line from direct sunlight by keeping it stowed, preventing ultraviolet degradation. The distance that the retrieval line extends should be dependent upon the strength of the person operating the device, rather than by a restriction in the retrieval line from a snarl, kink or snag. Another object of the present invention is to combine the flotation cushion and the life ring buoy with the retrieval line and an illuminating source, such as a strobe light, into a single device.

SUMMARY OF THE INVENTION

The present invention employs a retrieval line that is secured internally with the life ring buoy or the flotation cushion. A portion of the retrieval line protrudes from its housing so that it can be quickly and easily accessed. This portion is a spliced eye loop that can be easily grabbed and secured by gripping it with a hand or an anchoring structure. A protective sleeve covers the spliced eye loop protecting it from ultra violet exposure. The retrieval line will remain intact substantially longer than current arrangements of the retrieval line.

The present invention employs an upper rubber extrusion and lower rubber extrusion to enclose the retrieval line within the floatation device. Upon the present invention being deployed, the retrieval line passes through a gap between the rubber extrusions, allowing the retrieval line to freely exit its housing and release snarl free to the person in distress. Furthermore, the upper and lower rubber extrusions protect the retrieval line from harmful ultraviolet light by preventing the ultraviolet light from entering the housing.

The present invention employs the use of bright lights. In the process of deploying the present invention, the light sources illuminate. These light sources facilitate locating the flotation cushion or life ring buoy and the retrieval of the flotation cushion or life ring buoy. Therefore, a person in distress or rescuers can visually see where the life ring buoy or flotation cushion is located.

The present invention employs the use of a retrieval line, an internal protective housing for the retrieval line, an upper and lower rubber extrusion to the protective housing and illuminating light sources into single floatation device with either a flotation cushion or life ring buoy. Throwing the flotation device will be more accurate and will be able to be delivered greater distances with this present invention. It is expected that drowning rescue attempts will become swifter and more effective by using the present invention in such emergency situations.

DETAIL DESCRIPTIONS OF THE INVENTION

All illustrations of the drawings are for the purpose of describing selected versions of the present invention and are not intended to limit the scope of the present invention.

Figure 8:
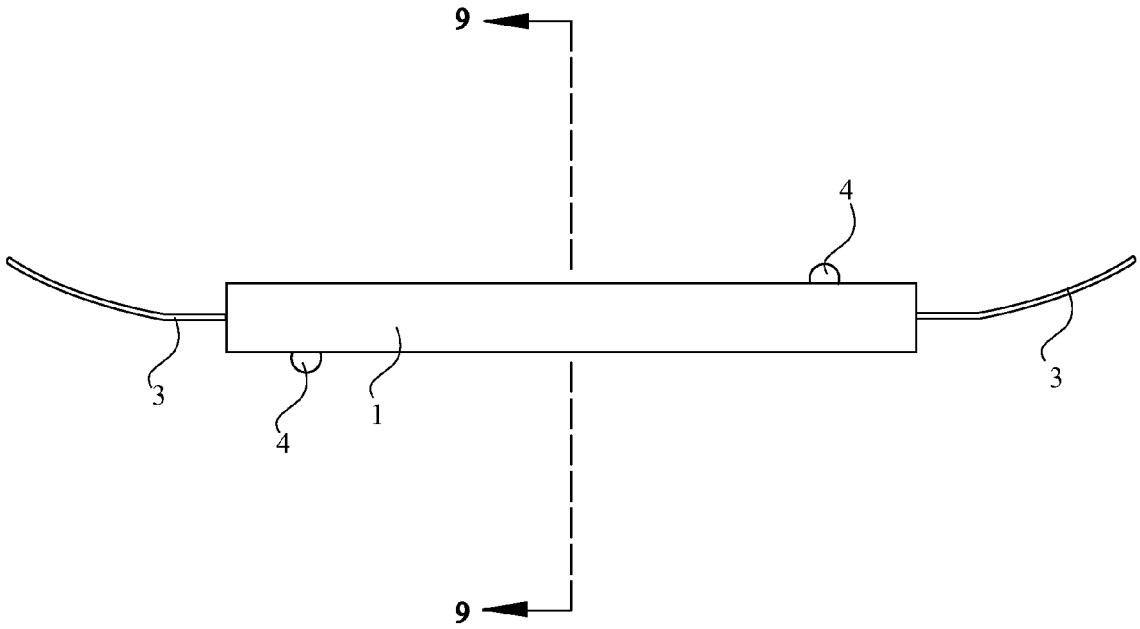
FIG. 8 is a side view of the improved floatation cushion invention. Showing the line 9-9 which a cross section is taken in FIG. 9.
Figure 9:
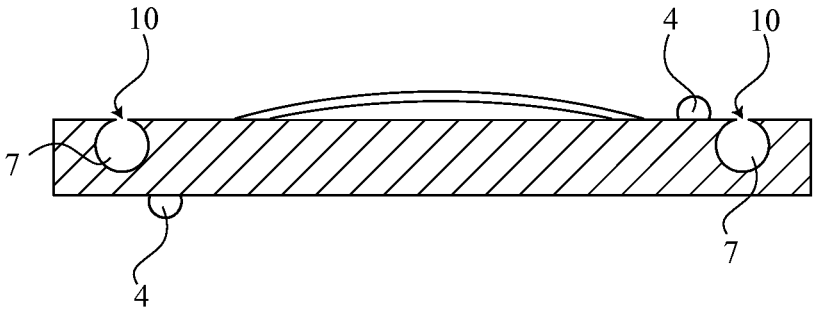
FIG. 9 is a cross section view of the improved floatation cushion invention.
Figure 10:
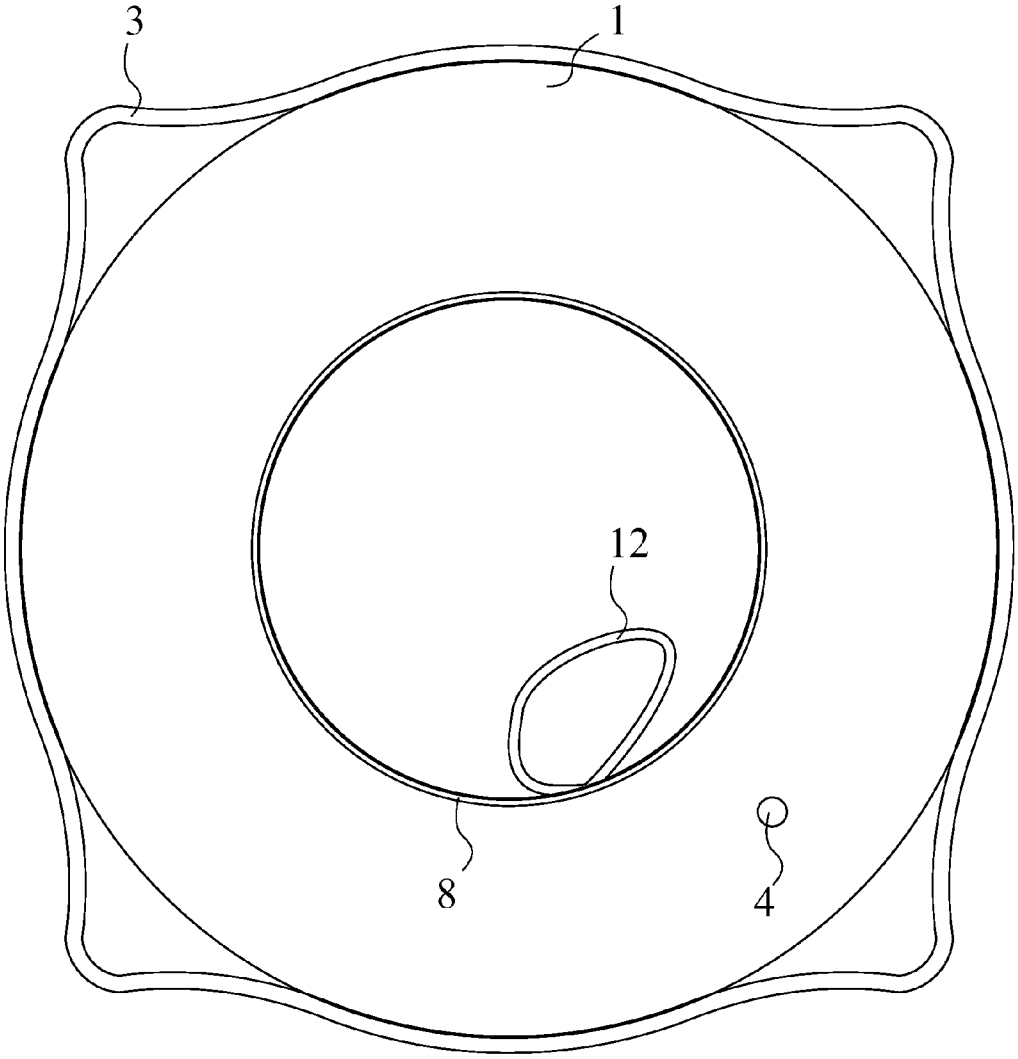
FIG. 10 is a front view of the improved life ring buoy invention, without the nylon beckets.

As can be seen in FIG. 1-FIG. 6 & FIG. 10, the first embodiment of the present invention is a life ring buoy, which is used to aid and retrieve a person in distress within a body of water. Also, as can be seen from FIG. 7-FIG. 9, the present invention has an alternative embodiment as a flotation cushion, which functions in the same manner as the first embodiment of the present invention. Essentially, the present invention is facilitated by throwing a flotation device 1 near the person in distress, while holding the spliced eye 12 of the retrieval line 2 which the flotation device 1 is attached to. The present invention comprises a flotation device 1, a retrieval line 2 and a plurality of illuminating sources 4. The flotation device 1 provides aid to a person in distress. After it has been deployed, the plurality of lights 4 are illuminated making the flotation device 1 distinctly noticeable, even in restricted visibility or darkness. These illuminating sources 4 are embedded in the flotation device 1. An individual seeking the flotation device 1 only needs to seek the light source to find the flotation device 1. The retrieval line 2 is secured to the flotation device 1 so the rescuer or the individual operating the present invention can retract the retrieval line 2 to bring the distressed person to a safe location.

Figure 4:
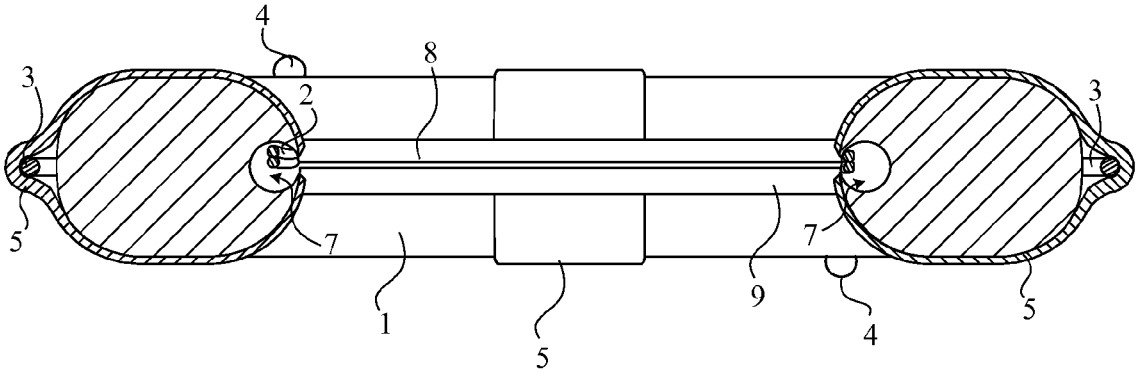
FIG. 4 is a cross section view of the improved life ring buoy invention.
Figure 6:
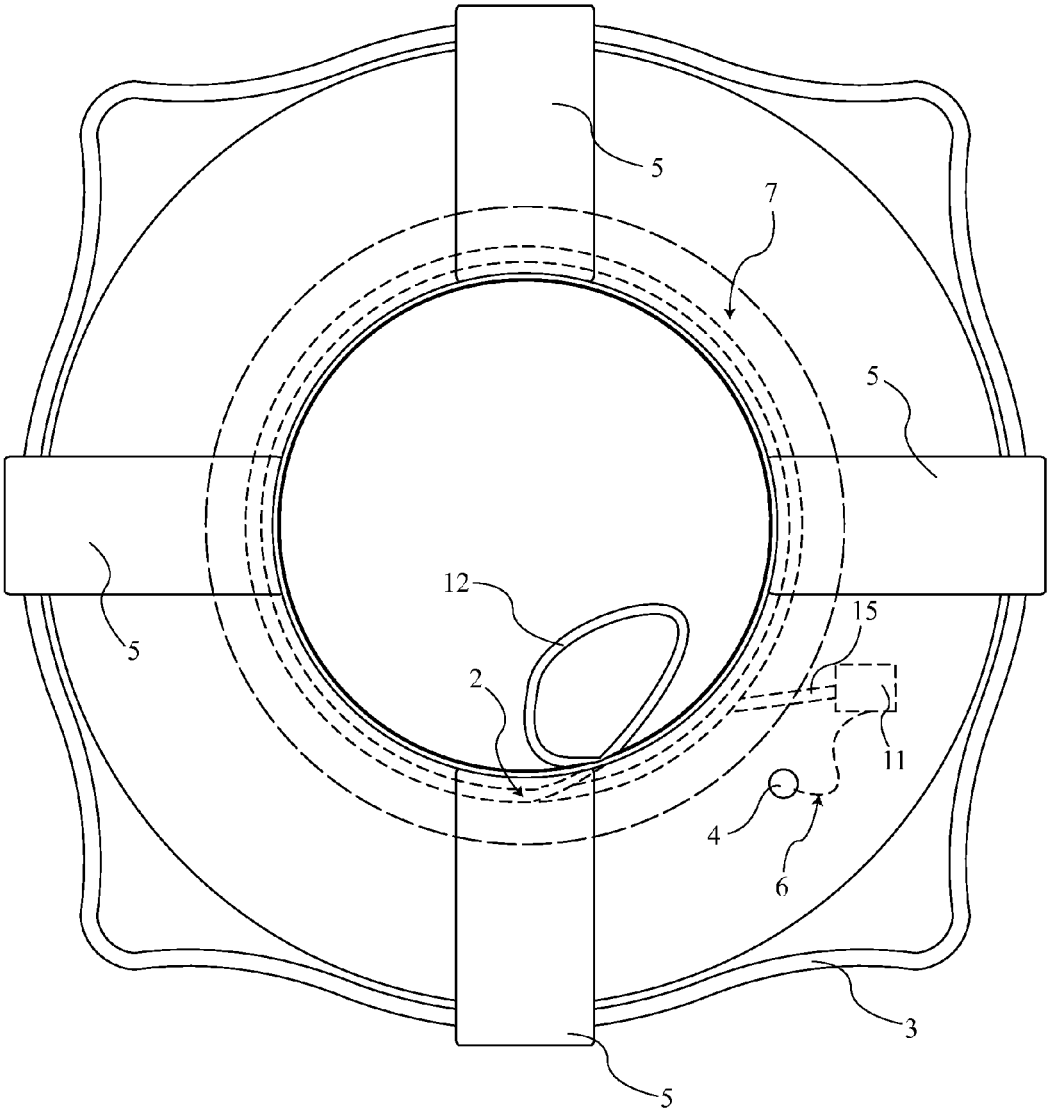
FIG. 6 is the front view of the improved life ring Showing the internal components using dashed lines.

The flotation device 1 comprises a recessed cavity 7, an open slit 10, a lower rubber extrusion 9, an upper rubber extrusion 8 and an electrical switch 11. The recessed cavity 7 is concentrically positioned within the flotation device 1. The open slit 10 traverses through the flotation device 1 into the recessed cavity 7. The preferred embodiment of the recessed cavity 7 is an internal cavity within the flotation device 1 Specifically, the recessed cavity 7 is used to house the retrieval line 2. The retrieval line 2 is neatly coiled and/or stored within the recessed cavity 7. The retrieval line 2 comprises a first end 14, and a spliced eye loop 12. The spliced eye loop 12 is connected to the first end 14 and is connected flotation device 1 within the recessed cavity 7. In the aforementioned description, most of the retrieval line 2 is housed within the recessed cavity 7—the portion protruding from the recessed cavity 7 is the spliced eye loop 12. An example of the retrieval line 2 being housed within the recessed cavity 7 is shown in FIG. 4 and FIG. 6. The spliced eye loop 12 is essentially the looped end of the retrieval chord 2 that the rescuer holds. The spliced eye end 12 of the retrieval line 2 is protected from exposure to sunlight by a synthetic sleeve. The spliced eye loop 12 may be enwrapped to any rigid anchoring structure. By securely anchoring or gripping the spliced eye loop 12, a user can be ensured that the present invention and rescued person will not be lost to strong water currents or any outside forces that could increase the tension in the retrieval chord 2.

Figure 1:
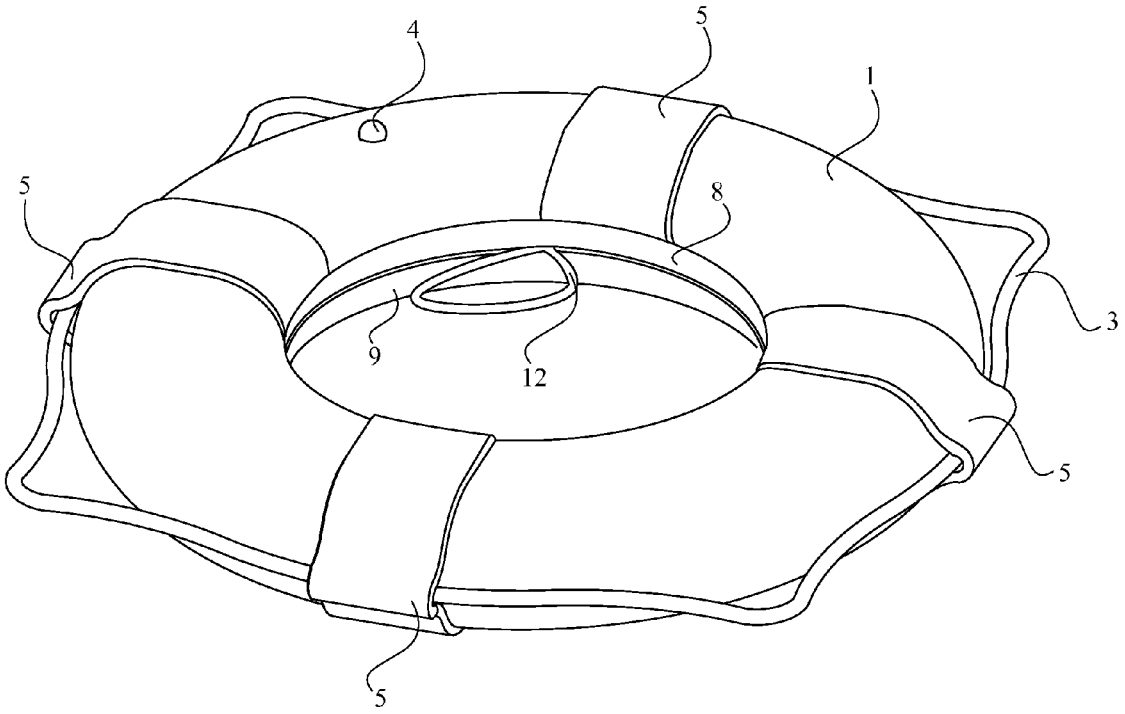
FIG. 1 is a perspective view of the improved life ring buoy invention.
Figure 2:
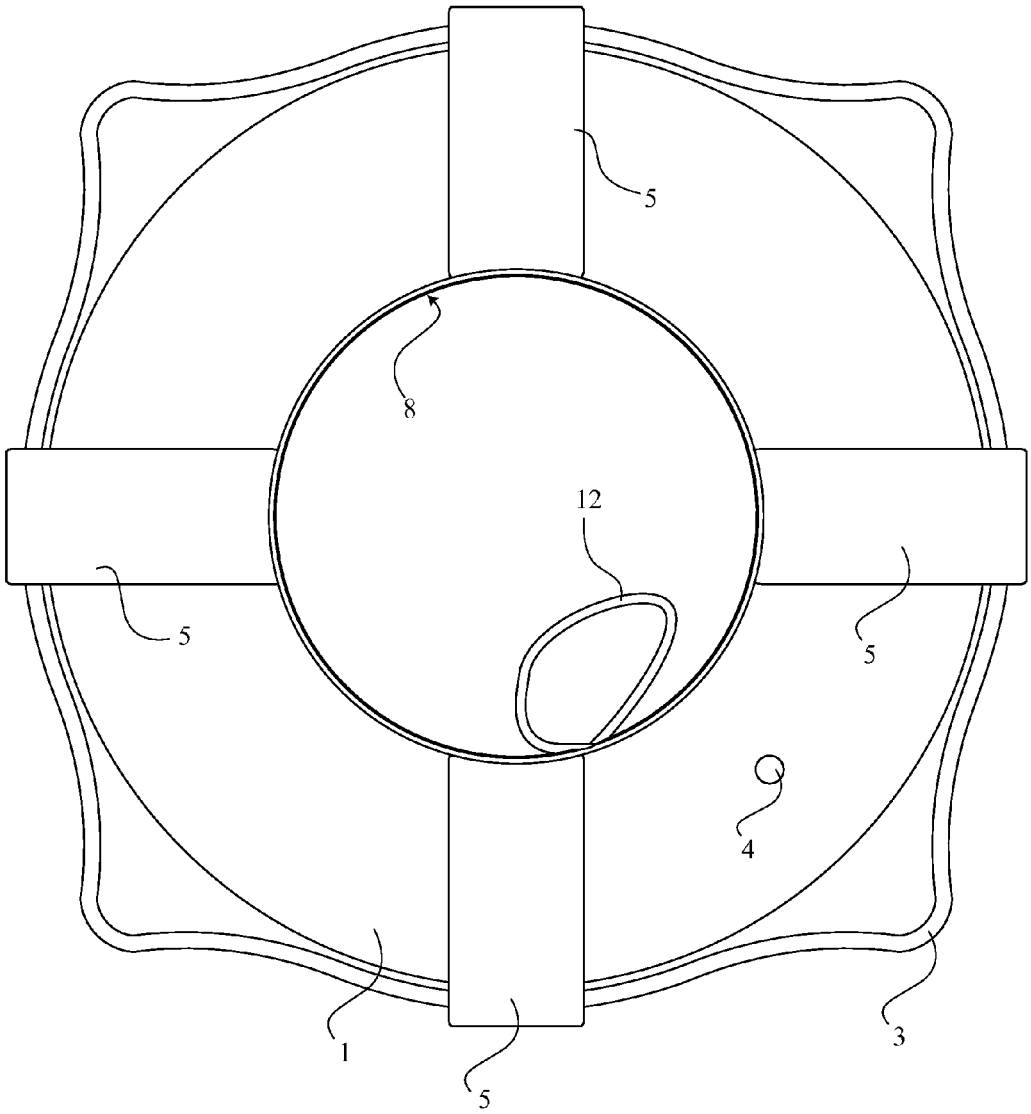
FIG. 2 is a front view of the improved life ring buoy invention.
Figure 3:
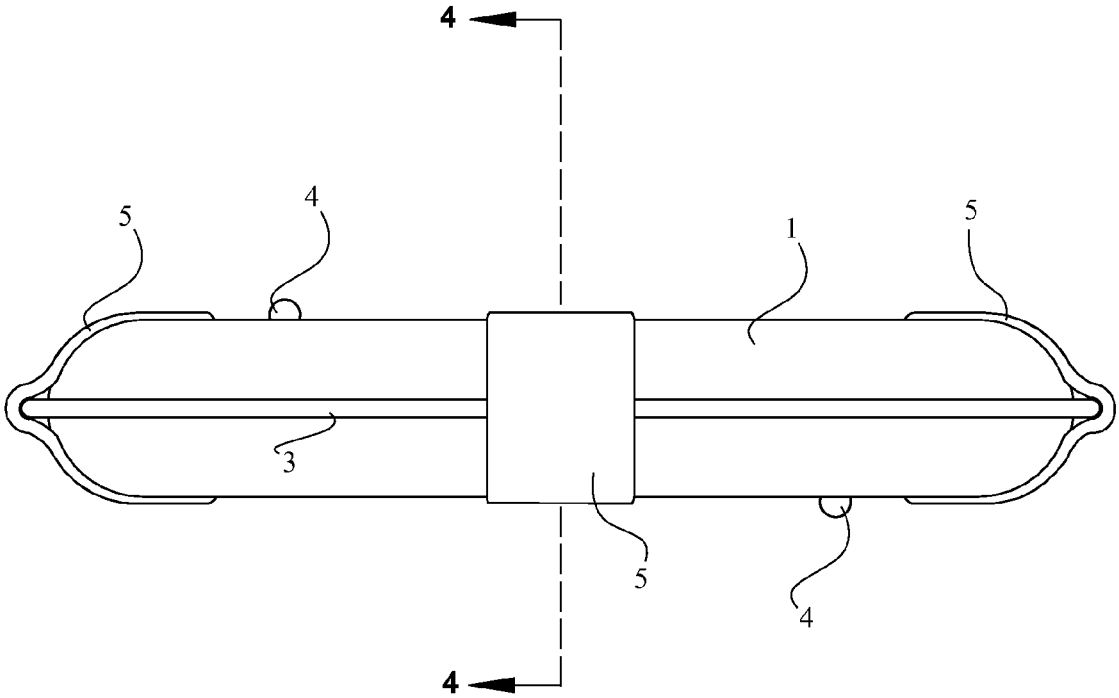
FIG. 3 is a side view of the improved life ring buoy invention. Showing the line 4-4 which a cross section is taken in FIG. 4.
Figure 5:
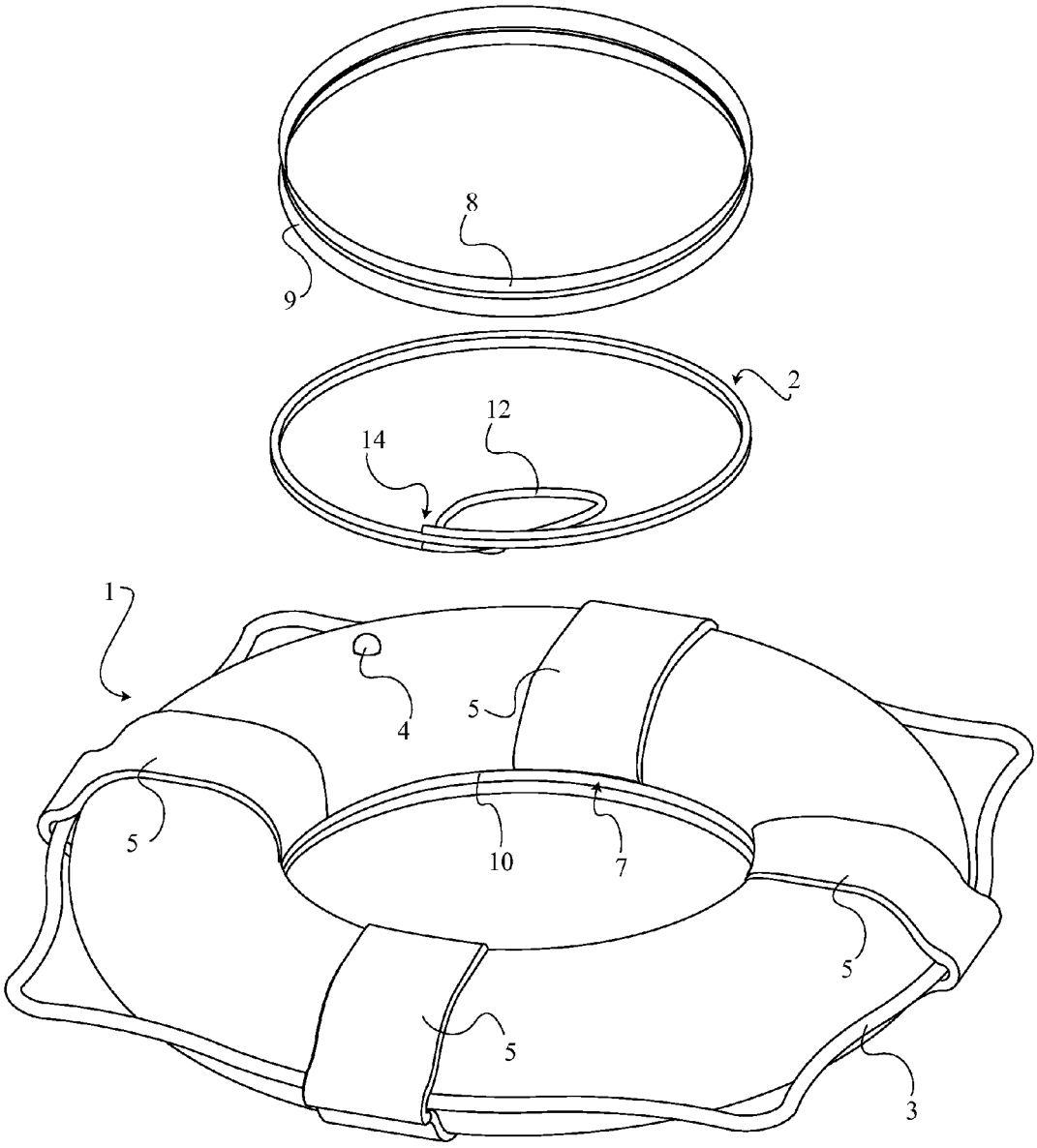
FIG. 5 is an exploded perspective view of the improved life ring buoy invention.
Figure 7:
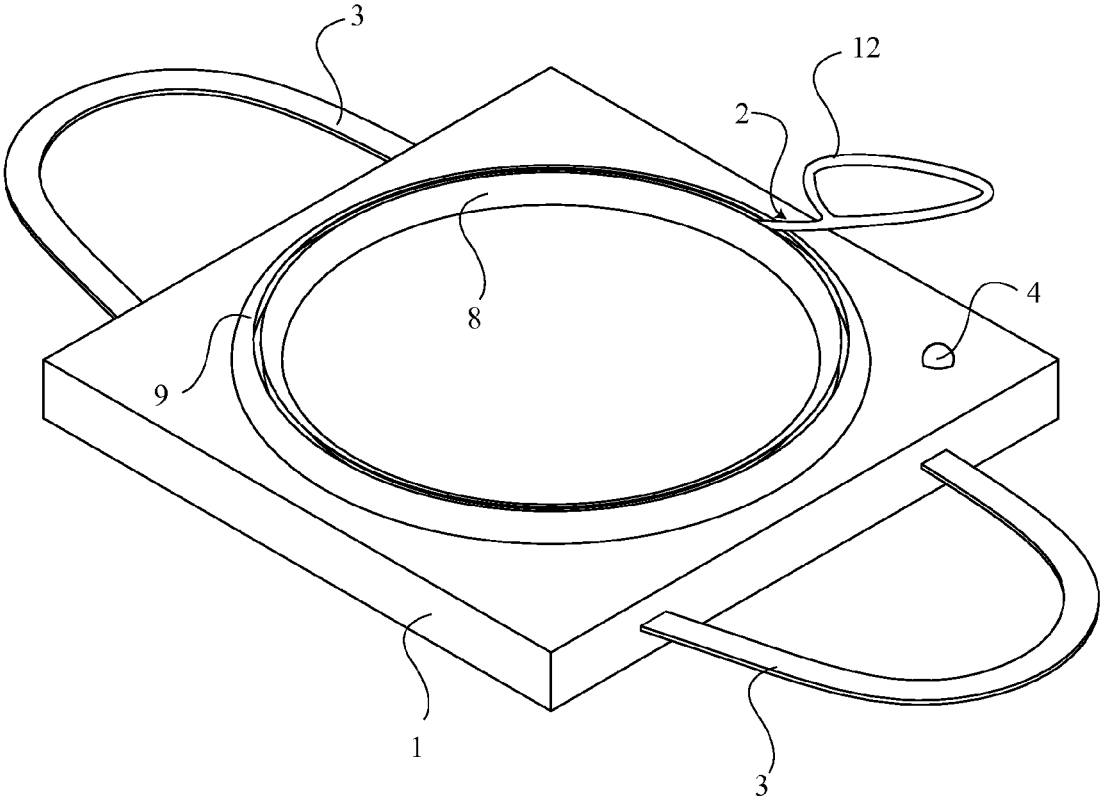
FIG. 7 is the perspective view of the floatation cushion

As is shown in FIGS. 1, 4 and 7, the open slit 10 is enclosed by both the upper rubber extrusion 8 and the lower rubber extrusion 9, which houses the retrieval chord 2; FIG. 5 is an exploded view of the present invention showing the retrieval chord 2, the upper rubber extrusion 8, the lower rubber extrusion 9 and the flotation device 1. The upper rubber extrusion 8 is affixed or adhered to the flotation device 1 above the open slit 10, while the lower rubber extrusion 9 is affixed or adhered to the flotation device 1 below the open slit 10. Each extrusion partially encloses the open slit 10; however, the upper rubber extrusion 8 and lower rubber extrusion 9 as combination will not fully close the open slit 10. In the aforementioned description, the spliced eye loop 12 is protruding from the open slit 10; therefore the spliced eye loop 12 traverses between the upper rubber extrusion 8 and the lower rubber extrusion 9. The spliced eye end 12 of the retrieval line 2 is protected from exposure to sunlight by a synthetic sleeve. In the preferred embodiment of the upper rubber extrusion 8 and the lower rubber extrusion 9, these are pliable, structurally, such that the retrieval chord 2 should only encounter minimal resistance as it exits the recessed cavity 7—after the flotation device 1 is deployed. Upon deploying the floatation device 1 the retrieval chord 2 traverses through the open slit 10 and between the upper rubber extrusion 8 and the lower rubber extrusion 9.

The flotation device 1 uses a plurality of illuminating sources 4 to produce light when the flotation device 1 is deployed. Each of the plurality of illuminating sources 4 is embedded in the flotation device 1. The embodiment of these illuminating sources 4 may either protrude from the surface of the flotation device 1 or be flush with its surface. Also, these illuminating sources 4 can be positioned anywhere on the flotation device 1, and preferably are positioned on both the front and the back of the flotation device 1. This allows the flotation device 1 to be seen from any angle or vantage point. The illuminating sources 4 are switched on by the retrieval chord 2 and electrical switch 11.

The internal components and electrical connections are shown in FIG. 6. The retrieval chord 2 comprises a switch member 15 that is electrically connected to the electrical switch 11 and also mechanically connected to the retrieval chord 2. As the retrieval chord 2 is unwound during the deployment of the flotation device 1, the switch member 15 triggers the electrical switch 11; by triggering the electrical switch 11, power is then delivered to each illuminating source 4. Upon receiving power, each illuminating source 4 begins to produce a bright light. Also, the illuminating source 4 is not limited to any form of lighting technology and may be a light emitting diode (LED) or a halogen bulb, for example. To this end, the preferred embodiment of the switch member 15 is a key that provides electrical flow through the electrical switch 11 and upon its removal from the electrical switch 11; electricity is permitted to flow—to the plurality of illuminating sources 4. The switch member 15, or key, is removed from the electrical switch 11 as the retrieval chord 2 exits the recessed cavity 7 because the switch member 15 is mechanically connected to the retrieval chord 2. Electrical power is delivered to the plurality of illuminating sources 4 from the electrical switch 11 through a plurality of wires 6 or any similar existing or future technology. However, it should be known that the illuminating source 4 can be powered in numerous ways through an electrical switch 11 and that the present invention should not be limited to any single method for as long as the illuminating sources 4 are powered up upon deploying the flotation device 1.

The present invention further comprises a grab line 3 and a plurality of beckets 5, which are used to deploy the flotation device 1 and are available to the distressed person to obtain and hold onto the flotation device 1. The grab line 3 is enwrapped around the outer perimeter of the flotation device 1. In the alternative embodiment of the present invention, FIG. 7-FIG. 9, the present invention is a flotation cushion. This embodiment uses plurality of grab lines 3. The flotation cushion functions in the same manner as the life ring buoy, the first embodiment, and is comprised of the same components.

An additional novelty of the present invention is that it provides the retrieval chord 2 with protection from ultraviolet exposure when it is not in use. Since the retrieval chord 2 is housed within the recessed cavity 7, ultraviolet light is blocked and prevented from reaching it.

Although the invention has been explained in relation to its preferred embodiment, it is to be understood that many other possible modifications and variations may be made without departing from the spirit and scope of the invention as hereinafter claimed. The aforementioned concept disclosures and description of this invention are not intended to be limiting.

What is claimed is:

1. A life ring buoy and flotation cushion comprises, a flotation device;

an internally housed retrieval line;

a plurality of illuminating sources;

a plurality of wires;

the flotation device comprises a recessed cavity, a lower rubber extrusion, an upper rubber extrusion an open slit and an electrical switch;

the retrieval line comprises a spliced eye loop, a first end, a second end, and a switch member;

the recessed cavity being concentrically positioned on the flotation device;

the open slit traversing the flotation device into the recessed cavity;

the upper rubber extrusion being affixed to the flotation device above the open slit;

the lower rubber extrusion being affixed to the flotation device below the open slit;

the retrieval line being housed by the recessed cavity;

the spliced eye loop being the first end;

the second end being secured to the floatation device inside the recessed cavity;

the spliced eye loop protruding through the open slit;

the open slit being enclosed by both the upper rubber extrusion and the lower rubber extrusion;

the plurality of illuminating sources being electrically connected to the electrical switch by the plurality of wires;

the switch member being connected to the retrieval line; and the switch member being electrically connected to the electrical switch.

2. The life ring buoy and flotation cushion as claimed in claim 1 comprises, the plurality of illuminating sources being affixed to the flotation device; and the retrieval line being mechanically connected to the electrical switch by the switch member.

3. A life ring buoy and flotation cushion comprises, a flotation device;

a retrieval line;

a plurality of illuminating sources;

a plurality of wires;

the flotation device comprises a recessed cavity, an upper rubber extrusion, a lower rubber extrusion, an open slit and an electrical switch;

the retrieval line comprises a spliced eye loop, a first end, a second end, and a switch member;

the recessed cavity being concentrically positioned on the flotation cushion;

the open slit traversing the flotation device into the recessed cavity;

the open slit being enclosed by both the upper rubber extrusion and the lower rubber extrusion;

the retrieval line being mechanically connected to the electrical switch by the switch member;

the plurality of illuminating sources being electrically connected to the electrical switch;

the retrieval line being housed by the recessed cavity;

the upper rubber extrusion being affixed to the flotation device above the open slit;

the lower rubber extrusion being affixed to the flotation device below the open slit;

the plurality of illuminating sources being affixed to the flotation device;

the spliced eye loop being connected to the first end;

the second end being connected to the floatation device in the recessed cavity; and the spliced eye loop protruding through the line opening;

the retrieval line being mechanically connected to the electrical switch by the switch member;

the plurality of illuminating sources being electrically connected to the electrical switch by the plurality of wires; and the switch member being electrically connected to the electrical switch.

* * * * *